United States Patent [19]

Tucker

[11] Patent Number: 4,907,301

[45] Date of Patent: Mar. 13, 1990

[54] METHOD FOR SETTING TOILET BOWLS

[76] Inventor: Richard J. Tucker, 237 S. Spring, La Grange, Ill. 60525

[21] Appl. No.: 260,198

[22] Filed: Oct. 20, 1988

Related U.S. Application Data

[63] Continuation-in-part of Ser. No. 34,678, Apr. 6, 1987, abandoned.

[51] Int. Cl.[4] ..... E03D 11/16

[52] U.S. Cl. ..... 4/252 R; 285/56; 285/64

[58] Field of Search ..... 4/252 R; 285/56, 57, 285/58, 59, 60, 64; 403/408.1, 337; 411/174, 175, 523

[56] References Cited

U.S. PATENT DOCUMENTS

| | | | |
|---|---|---|---|
| Re. 22,926 | 10/1947 | Tinnerman | 411/175 |
| 1,221,456 | 4/1917 | Kersten | 411/170 |
| 1,878,199 | 9/1932 | Stenger | 411/170 |
| 2,324,653 | 7/1943 | Tinnerman | 411/259 |
| 2,716,434 | 8/1955 | Crowther | 411/106 |
| 3,180,660 | 4/1965 | Brewington | 285/60 |
| 3,181,585 | 5/1965 | Brewington | 285/60 |
| 3,414,035 | 12/1968 | Munse | 411/175 |
| 3,426,818 | 2/1969 | Derby | 411/175 |
| 3,430,991 | 3/1964 | Otto | 285/206 |
| 3,797,548 | 3/1974 | Barnett et al. | 151/41.75 |
| 3,905,052 | 9/1975 | De Angelis | 4/252 R |
| 3,921,229 | 11/1975 | Yavitch | 4/252 R |
| 4,227,722 | 10/1980 | Barber | 4/252 R |
| 4,261,598 | 4/1981 | Cornwall | 285/56 |
| 4,355,828 | 10/1982 | Taunton | 4/252 R |
| 4,406,480 | 9/1983 | Izzi | 4/252 R |

*Primary Examiner*—Henry J. Recla
*Assistant Examiner*—Edward C. Donovan
*Attorney, Agent, or Firm*—Robert J. Van Der Wall

[57] ABSTRACT

A method and associated reusable apparatus providing for efficiently, but removably mounting a toilet bowl base to the flange of a soil pipe projecting through the floor and which uses steps requiring no skills, tools or judgment to accomplish. A pre-existing color matched decorative cover cap is employed. An eccentric c-shaped resilient retaining clamp is placed in alignment with an aperture in the soil type flange, a prethreaded headless mounting stud is inserted and manually adjusted to an appropriate height to prevent interference with the pre-existing cover cap and to compensate for uncertain height of the soil pipe flange above the floor surface, the toilet bowl base is placed in position, is fastened using a wing nut which is hand tightened to avoid excessive axial pressure that would crack the toilet bowl base, and the pre-existing cover cap is then placed thereover.

3 Claims, 1 Drawing Sheet

METHOD FOR SETTING TOILET BOWLS

CROSS REFERENCE TO RELATED APPLICATIONS

This application is a continuation in part of the copending application, Ser. No. 034,678, abandoned, filed Apr. 6, 1987 and claims the same filing date as the earlier application as to the common subject matter.

FIELD OF THE INVENTION

The present invention relates to the field of toilet bowl installation. More particularly, the present invention relates to a method and associated reusable apparatus that provide for efficiently, but removably, mounting a toilet bowl base to the flange of a soil pipe projecting through the floor of the bathroom and which uses a sequence of steps requiring no skill, tools or judgment to accomplish. A mounting stud retaining clamp holds a special mounting stud in a precise, predetermined and secure location. An axial pressure limiting wing nut is use to attach and hold the toilet bowl base in a manner that prevents cracking of same. The method eliminates the use of loose bolts that, during the installation, are frequently held in place by putty, wax, tape or similar contrivances until the toilet base is lowered into position. It also eliminates sawing off the ends of bolts projecting through the holes in the toilet bowl base.

BACKGROUND OF THE INVENTION

The customary and usual method of toilet bowl installation employs the use of two or more long bolts having elongated heads. The heads of the bolts bear against the underside of the soil pipe flange when the bolts are inserted from beneath into slots or holes formed in the soil pipe flange. Because there is normally no positive means to retain the bolts erect and in place in the flange soil pipe, and since the heads of the bolts are on the underside of the soil pipe flange, the bolts may be easily dislodged during the placing of the toilet bowl and wax sealing ring over the soil pipe flange. They cannot, of course, be held in place manually, because the toilet bowl base completely covers the flange of the soil pipe as the base is lowered into position. Thus the bolts tend to fall downward under gravity if even touched during the placing of the toilet place in position in and, if this occurs, this necessitates removal of the toilet bowl so that the one or more bolts may again be placed in position. In addition to presenting a very frustrating situation, it is likely that the wax sealing ring placed between the soil pipe flange and the toilet base may be damaged due to placement, removal and resetting of the toilet bowl base one or more times. This situation may occur even when the bolt heads are sought to be temporarily held in place by the use of putty, wax, tape or similar contrivances, and this is especially so when the installation is being performed by inexperienced persons.

The prior art apparatus also uses a conventional nut to tighten together the combination of the soil pipe flange, wax ring and toilet bowl base. Since this nut is tightened by the use of a common wrench, excess pressure sometimes is applied and the ceramic body of the toilet bowl base may be cracked or broken, especially when done by inexperienced persons.

The novel method of the present invention includes use of a hardened spring tensioned eccentric clamp that is placed over the slot in the soil pipe flange, and which will conform to any such flange in use at present because of its resiliency. The bottom portion of the clamp lies against the underside of the flange and is fitted with threads for receiving a headless threaded stud. No bolts are used and no tool is needed. The upper portion of the clamp is provided with a hole which is not threaded, but is of a size to permit the free passage of the stud. This upper hole assures, without installer skill, a vertical and substantially perpendicular alignment of the threaded stud with the bottom portion of the clamp. The uppermost end of the threaded stud is provided with a slot in the form of a common screwdriver slot which is normally not used in installation, but which is available for ease of removal as sometimes needed long after installation. The headless stud may be easily adjusted without any tool as to height above the toilet bowl, thus allowing the decorative cover cap to fit properly. This, in turn, eliminates the common practice of sawing off excess bolt length as is presently practiced in the industry. The bolts presently used cannot be accurately sized in advance because the height of the soil pipe flange above the floor is a variable, and excess bolt length cannot be tolerated because the decorative cover caps will not fit properly over the end of the bolt and nut threaded thereover if the bolt end projects too far through the hole in the toilet bowl base. That is why excess bolt length is sawed off if the same is too long.

In any event, the threaded stud of the present invention is held securely by the threaded bottom portion of the retaining clamp and thus the stud cannot be dislodged as the toilet bowl is placed into position over the soil pipe flange. The consequence is that toilet bowl installation is quick and simple, even for a do-it-yourself installer with no previous experience.

Two recent searches of the prior art relating to this field did not disclose or suggest the present method, although various components of the apparatus employed in the method are known. The principal novelty of the present invention resides in the method that differs in so many ways from the closest known prior art reference, hereinafter discussed at length. The method is facilitated by several components that do bear some resemblance to other, but nonanalogous art references, but these nonanalogous art references do not teach or suggest the unique series of steps of the present method, which leads to a much improved result that is strikingly different from the totality of the prior art.

The most relevant, and analogous, prior art appears to be U.S. Pat. No. 3,181,585 by Brewington although there are a substantial number of differences between it and the present invention. Brewington teaches an anchoring bolt for water closet bowls and includes a three piece apparatus comprising a retainer adapted to slide into those types of soil pipes that include a bayonet slot of the flange, a headless steel screw for threaded engagement with said retainer, and a bolt (cap) that may be made from nylon or lead and which has a head preferably hexagonal in shape for reception of a wrench. This reference's retainer will not work with certain soil pipe flanges, such as copper flanges presently in use that have holes rather than slots. The eccentric construction of retaining clamp of the present invention will straddle the edge of such a flange and align with both the top and bottom of such a hole. Furthermore, this eccentric retaining clamp is resilient and will conform to the shape of any flange, as opposed to Brewington's retainer.

Brewington teaches elimination of the customary decorative cover cap, contrary to the teachings of the present invention. The effect is to expose to permanent view a bolt that is unsightly, as opposed to a decorative cap of identical color with the toilet. Such bolts will hardly ever be of an identical color with the toilet because they are produced by a different manufacturer than the toilet is, making true color matching virtually impossible.

Brewington requires the use of a wrench or similar tool, which is also contrary to the present invention. Moreover, because this reference does utilize such a wrench, it does not have the axial pressure limiting features appropriate to eliminate cracking or chipping of the ceramic toilet bowl base, which is one of the principal purposes of the present invention.

Further, the use of a wrench on the nut of Brewington can be expected to produce scarring because the preferred materials are lead or nylon which are soft. Such scarring is permanently exposed to view making the result even more unsightly than simply the color difference and the fact that a nut is exposed to view.

Reusability with Brewington is problematical. If a toilet bowl base must be removed from the soil pipe to clear an obstruction therein, disassembly of Brewington in the same sequence as assembly is not assured, because it teaches self-tapping of threads in both the nut and retainer as a consequence of torque applied by the wrench, leaving in question which of the nut or retainer will become unthreaded when a loosening torque is applied to the nut on disassembly. In contrast, the present invention contemplates the ability to disassemble and reuse its component parts in the sequence in which they were installed, not depending upon chance resistance of the threads in the retainer and nut, as in Brewington. In contrast, the present invention is both readily removable and reusable.

The use of smooth bore parts in Brewington, namely the bolt and retainer, especially the latter, means that alignment is critical and skill is required to assemble its components. No such skill is required to use the method of the present invention in installing a toilet bowl.

Brewington, as noted above, teaches elimination of the decorative cover caps. In addition to the aesthetic disadvantages, there are two practical disadvantages to deletion of the cover caps. The first is that these caps prevent condensation and other corrosion causing agents from seeping down to the threads of the stud and retainer. The other is that these caps prevent wax from the wax sealing ring from oozing through the ends of the normally elongated openings in the toilet bowl base, or at least hide it from view and dirt contamination of the oozed wax, which is even more unsightly.

The method of the present invention contemplates the ability to preadjust the height of the threaded stud to accommodate the uncertain height of the soil pipe flange above the floor. The mounting stud is hand threaded into the retaining clamp to a proper height to allow clearance of the top of same underneath the decorative cover caps when the same are placed in position. No skill, judgment or tool is required. This establishes the absence of an obstruction before setting the toilet bowl and damaging the wax ring.

In summary, Brewington differs from the present invention in at least the following respects:

1. The present invention prevents cracking of the toilet bowl by using axial pressure limiting wing nuts.

2. The present invention does not require tools to use.

3. The present invention avoids unsightliness due to scarring of visible parts because no tools are needed.

4. The present invention requires no installing skill.

5. The present invention requires no installer judgment because mounting stud height can be predetermined before the toilet bowl is set onto the wax ring.

6. The present invention allows elimination of any obstruction before the toilet bowl is set on the wax ring because of the foregoing height predetermination feature.

7. The present invention uses an eccentric resilient retaining clamp that is usable with all soil pipe flanges and conforms to them. It is specifically usable with copper flanges or others having only round holes therein.

8. The component parts contemplated by the presently inventive method are readily removable.

9. The component parts contemplated by the presently inventive method are readily reusable if removed.

10. The presently inventive method uses decorative cover caps to protect nuts and bolts, etc. from condensation and other corrosive agents.

11. The present invention uses decorative cover caps to either prevent oozing of wax from the wax ring through the ends of the normally elongated openings in the toilet bowl base, or at least hide it from view and dirt contamination.

12. The present invention uses decorative cover caps made by the same manufacturer as the toilet bowl which results in an exact color match between the toilet and the decorative cover caps.

13. The present invention hides unsightly nuts from view using the same decorative cover caps.

All thirteen points represent distinctions from the disclosure of Brewington.

A number of U.S. patents disclose various fasteners for use with a threaded bolt or screw but they are non-analogous art in the context of the inventive method. One example is U.S. Pat. No. 3,797,548, issued to Barnett, et al., which teaches a device intended by axial loading to resist rotation of a threaded fastener as a consequence of vibration as would be encountered in a carburetor or other part in proximity to an internal combustion engine. The reference does not teach or suggest use of same for holding a threaded fastener in place where access is prevented by the method or structure of assembly of any of article of manufacture or mechanism. The specific structure of the Barnett, et al. reference is a spring clip in use with a headless threaded fastener that includes a slot to receive a screwdriver or similar tool. The headless threaded fastener with a screwdriver slot is virtually identical to the threaded mounting stud of the present invention. The spring clip itself also bears some superficial resemblance to a mounting stud retaining clamp utilized in the present invention, but one of the arms thereof is split in a manner differing from the present invention and both arms are in a threaded engagement with the threaded fastener. The latter is an essential feature of the reference to achieve axial loading, which is irrelevant in the present invention. The invention teaches away from the present invention, even when viewed as a structure rather than as the method disclosed and claimed.

Another reference is U.S. Pat. No. 4,261,598 by Cornwall which includes the use of nuts that appear similar to the wing nuts of the present invention. However, Cornwall does not teach the use of such devices as axial pressure limiting fasteners, which is an essential aspect of the present invention. Thus the use of the wing nuts as employed in the present method to avoid cracking of a toilet bowl is not taught or suggested by Cornwall.

A further fastener art reference is U.S. Pat. No. 1,878,199 by Stenger, et al., which discloses a combination nut and lock washer. Although the device disclosed therein is similar to one of the components of the present apparatus, this disclosure does not teach the combination of the component parts of the present invention or the method of use as claimed herein.

Other references are Yavich, U.S. Pat. No. 3,921, 220; Brewington, U.S. Pat. No. 3,180,660; Barber, U.S. Pat. No. 4,227,702; Tinnerman, reissued U.S. Pat. No. RE 22926; Munse, U.S. Pat. No. 3,414,035; Derby, U.S. Pat. No. 3,426,818; DeAngelis, U.S. Pat. No. 3,905,052; Taunton, U.S. Pat. No. 4,355,828; Izzi, U.S. Pat. No. 4,406,480; Wagner, et al., U.S. Pat. No. 26,712; Crowther, et al.. U.S. Pat. No. 2,716,434; Kersten, et al., U.S. Pat. No. 1,221,456; Otto, et al., U.S. Pat. No. 3,430,991; and Tinnerman, et al., U.S. Pat. No. 2,324,653.

SUMMARY OF THE INVENTION

As previously described, the major problems arising during the installation of a toilet bowl are attributable to the customary use of loose bolts and ordinary nuts to fasten the toilet bowl to a soil pipe flange, maintain an acceptable fit to the level of the floor surface taken in combination with that flange, and to maintain a projection of the bolt above the retaining nut which will permit the use of a decorative bolt cover without having to saw off a part of the bolt that protrudes excessively. Loose bolts, as customarily used, are easily dislodged from the slots provided in the flange of the soil pipe, and when dislodged will fall below the flange and cannot be reached when the toilet bowl base is placed in position. The consequence is that the toilet bowl must be lifted away from the soil pipe so that the bolt may be again placed in proper position.

Bearing in mind the foregoing, it is a principal object of the present invention to provide a method for removably mounting a toilet bowl and attaching it to the soil pipe flange whereby the use of loose bolts is eliminated.

It is a primary object of the present invention to provide a securely mounted anchoring stud that will not be accidentally dislodged during toilet bowl installation.

It is a further object of the present invention to provide a mounting stud that is adjustable in height to accommodate the different heights of the soil pipe flange above the floor on which the toilet bowl base will rest.

Another object of the invention is to eliminate sawing off an excess protrusion of mounting bolts so that the decorative cover caps may fit properly.

One more object of the present invention is to provide anchoring nuts that must be tightened with the fingers of the hand rather than with a wrench.

A closely related object of the invention is to substantially eliminate the likelihood of cracking or chipping of the ceramic base of the toilet bowl caused by overtightening the nut on a conventional bolt by the use of a wrench.

A further object of the present invention is to provide a method of installing a toilet bowl base that can be easily performed by an inexperienced person, using no tools and requiring no judgment or skill.

An important object of the invention is to provide a method for installing a toilet bowl that accomplishes the other objects herein recited, but using decorative cover caps that are provided by the manufacturer of the toilet and which color match the same.

A connected object of the invention is to use said caps to hide mechanical fastening devices such as threaded fasteners, studs, nuts, nut shaped caps and the like.

Another connected object of the invention is to use said caps to either prevent oozing of wax from the wax ring through the ends of the normally elongated openings in the toilet bowl base, or at least hide it from view and contamination.

One more connected object of the invention is to use said caps to protect nuts and bolts, etc. from condensation and other corrosive agents, facilitating later removability and reusability.

An additional connected object of the invention is to use said caps in lieu of an exposed connector o fastener that is likely to be scarred when tightened with a wrench or similar tool.

One more object of the invention is to provide a method in combination with a particular combination of components that facilitates the method.

A further object of the invention is to facilitate the method by using components that are adaptable to virtually any toilet bowl base design.

Another object of the invention is to provide a method and accompanying apparatus which will save time and labor in the installation of toilet bowl bases and will also save material in the loss of wax rings which are damaged by multiple placement of the toilet base when conventional bolts are dislodged during installation.

A further object of the invention is to prevent the expense and delay of reinstallation when wax rings damaged by repetitive placement of the toilet bowl base during installation which results in leakage from the damaged wax ring.

In accordance with the present invention, there is provided a method for the installation of a toilet bowl base using decorative cover caps which eliminates the use of loose bolts that are easily dislodged from slots provided in the flange of a soil pipe when lowering a toilet bowl base over the soil pipe for installation. The method contemplates the use of a mounting stud retaining clamp which is attached to the soil pipe flange and into which is inserted a mounting stud. The mounting stud retaining clamp holds the mounting stud in a substantially vertical position in a manner which is positively retained so that the toilet bowl base can be lowered over it, the studs can penetrate openings in the toilet bowl base, and the toilet bowl base can be secured to the soil pipe flange using wing nuts which need only be hand tightened. Of course, a wax ring is normally placed between the toilet bowl base and the soil pipe flange to seal the connection therebetween.

A more specific recitation of the method of the present invention includes the placing of substantially U-shaped mounting stud retaining clamps to the soil pipe flange, normally in or about mounting holes or slots disposed thereon. Then a threaded stud is placed through the uppermost hole, which is non-threaded, and is turned downwardly into a threaded bottom portion of the mounting stud retaining clamp until the upwardly projecting stud reaches an appropriate height to avoid conflict with decorative cover caps later placed over same. A wax sealing ring is then placed in position to be compressed between the soil pipe flange and the toilet bowl base. A toilet bowl can then be lowered over the soil pipe with normally two upright studs passing through openings in the toilet bowl base. A suitable washer can then be placed over the projecting stud and a threaded wing nut placed on the upper end of the threaded stud and tightened downwardly until the base of the toilet bowl is in proper position and is secured against the soil pipe flange with the wax ring compressed therebetween. The projecting portion of the threaded stud is disposed low enough to permit a decorative cover cap to be placed over the stud and wing nut, hiding the same from view.

One additional benefit which may be realized from the adjustable nature of the mounting studs in situations where additional support to the soil pipe is advantageous, is that extending the bottom ends of the stud beyond the soil pipe flange to rest against the floor or other structure, will provide rigidity to the soil pipe and support derived from the connection of the stud with the floor and the soil pipe flange.

The invention will be better understood upon reference to the drawings taken in conjunction with a detailed description of the method.

DETAILED DESCRIPTION OF PREFERRED EMBODIMENT

Figure 1:
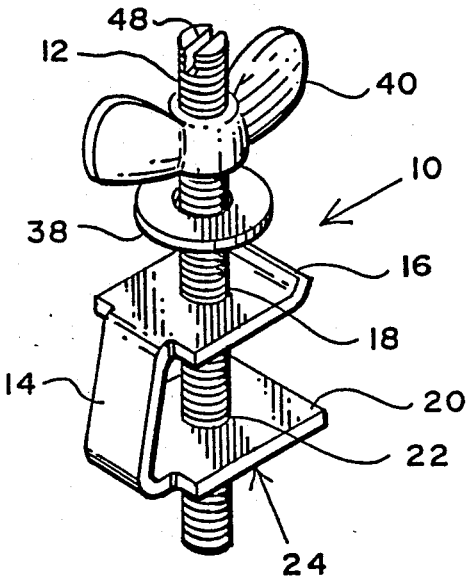
FIG. 1 is a perspective sideview of an assembly of component parts which facilitate the method of the invention.

FIG. 1 illustrates a preferred embodiment of the component parts of a toilet bowl fastening apparatus 10 that facilitates the method of this invention. The combination of component parts comprise a mounting stud retaining clamp 24, a threaded mounting stud 12, a washer 38, and a wing nut 40. The top of threaded mounting stud 12 includes a screwdriver slot 48.

Figure 2:
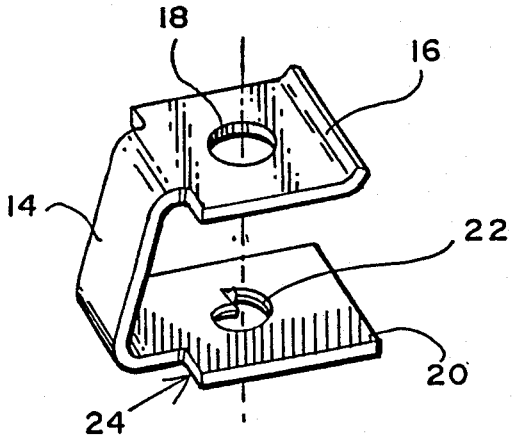
FIG. 2 is an enlarged perspective sideview of a mounting stud retaining clamp.

FIG. 2 shows an enlarged side perspective view of the lower mounting stud retaining clamp 24. It is an eccentric design comprised of a lower flat portion 20, a resilient riser portion 14, and an upper flat portion 16. In its preferred construction, mounting stud retaining clamp 24 includes an unthreaded hole 18 in upper flat portion 16, and a threaded hole 22 in lower flat portion 20. Unthreaded hole 18 contributes no axial load and is of a diameter to hold threaded mounting stud 12 erect, but is of a large enough diameter not to interfere with the threads thereof when mounting stud 12 is passed therethrough. Unthreaded hole 18 and threaded hole 22 are in substantially vertical alignment to maintain threaded mounting stud 12 in a substantially vertical position.

Figure 3:
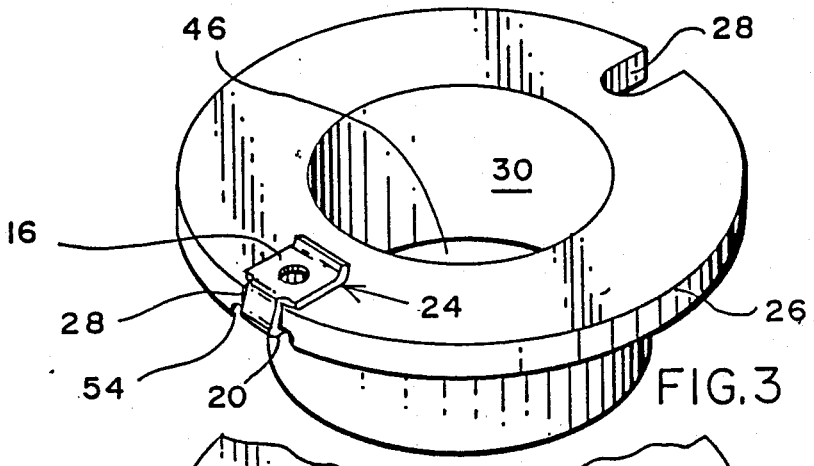
FIG. 3 is a top perspective view of a soil pipe flange showing slots in the flange and a mounting stud retaining clamp in one of the two slots.

Turning now to FIG. 3, a top perspective view of a soil pipe flange 26 is presented. Soil pipe flange 26 is provided with mounting slots 28 on opposite sides thereof. The underside of the mounting slots 28 are provided with underside recess 54. FIG. 3 illustrates a mounting stud retaining clamp 24 fitted over one of the mounting slots 28, the upper flat portion 16 gripping soil pipe flange surface 50 while the lower flat portion 20 is inserted into underside recess 54 to prevent mounting retaining clamp 24 from turning from any torque that results from threading thereinto threaded mounting stud 12, as shows in FIG. 4.

It will be understood that a second mounting stud retaining clamp 24 can be inserted into mounting slot 28 on the opposite side of soil pipe flange 26, but the same is not shown in FIG. 3. The interior wall 30 of soil pipe flange 26 is shown with an opening 46 for attachment of the soil pipe flange 26 to the soil pipe 42 shown in FIG. 5.

Figure 4:
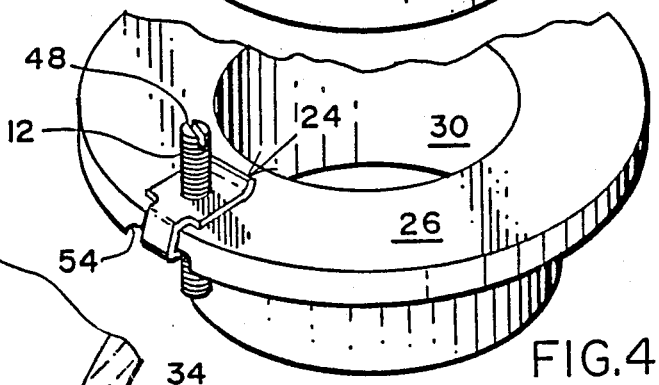
FIG. 4 is a partial top perspective view of a portion of a soil pipe flange showing a mounting stud retaining clamp and threaded mounting stud in a soil pipe flange slot, and also showing a screwdriver slot in the upper end of the threaded mounting stud.
Figure 5:
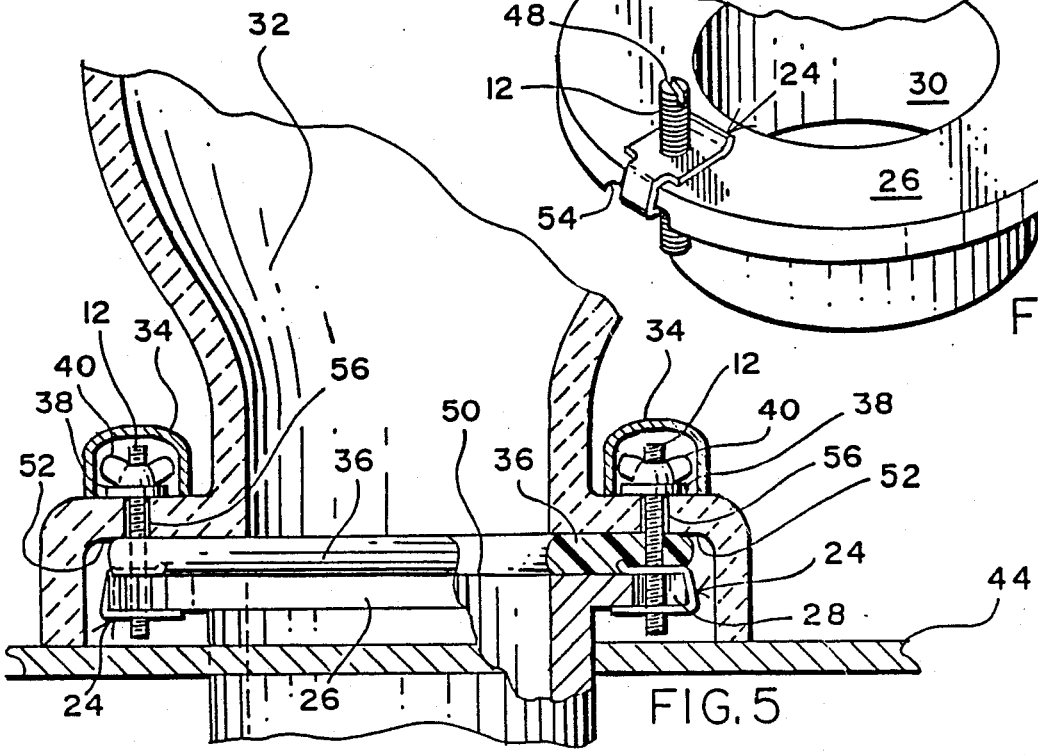
FIG. 5 is a partial cross-sectional side elevation view of a toilet bowl base (in phantom) mounted on a soil pipe flange and a floor, and also shows a wax sealing ring in place between the toilet bowl base and the soil pipe flange, with mounting stud retaining clamps in place on the soil pipe flange, a threaded mounting stud inserted therein, a washer and wing nut securing the toilet bowl to the soil pipe flange and wax sealing ring, with the decorative cover caps (also in phantom) covering the washers, wing nuts and upper portions of the mounting studs.

FIG. 4 offers a partial top perspective view of what was shown in FIG. 3, except that threaded mounting stud 12 has now been inserted therein and threaded by hand downward to a height that prevents conflict between the top of threaded mounting stud 12 and a colored decorative cover cap 34 as shown in FIG. 5. Visible is screwdriver slot 48 used for later removal if needed, underside recess 54, soil pipe flange 26, and mounting stud retaining clamp 24. In this manner, threaded mounting stud 12 is held against misalignment or accidental dislodgment when a toilet bowl base is lowered over the soil pipe flange 26.

Turning finally to FIG. 5, a typical toilet bowl installation when using the inventive method is illustrated with the apparatus that facilitates the method. Toilet bowl 32, shown in phantom, rests of floor 44, and is drawn securely toward the soil pipe flange 26 with a wax sealing ring 36 being compressed firmly between soil pipe flange surface 50 and underside 52 of toilet bowl 32. This is accomplished by the force of the two wing nuts 40 being turned on the threaded mounting stud 12 which studs are securely held by the threaded holes 22 in the lower flat portion 20 of the mounting stud retaining clamp 24, as shown in FIG. 2. Since the wing nuts 40 are tightened by the fingers of the installer, rather than by using a wrench, excessive pressure against washer 38 and ceramic toilet bowl base 32 is avoided and the likelihood of cracking or chipping the toilet bowl base 32 is eliminated. Commonly used decorative cover caps 34 supplied with the toilet and the same color as the toilet are placed over the ends of the threaded mounting studs 12, washers 38, and wing nuts 40 at the completion of the installation. With the toilet bowl set and sealed by the wax ring 36, effluent is passed through soil pipe 42 without odor or leakage, in the usual manner.

Using the combination of component parts previously described herein, a person without prior plumbing experience or special skills may properly install a toilet bowl, utilizing the following steps:

1. Placing a mounting stud retaining clamp 24 over holes or slots 28 of a soil pipe flange 26;

2. Inserting a threaded mounting stud 12 and manually turning said stud downwardly through the unthreaded hole 18 in upper flat portion 16 and then through threaded hole 22 in lower flat portion 20 of mounting stud retaining clamp 24 until the projecting portion of threaded mounting stud 12 attains a satisfactory projection so that clearance is provided for satisfactory placement of decorative cover caps 34 over the projecting studs 12 and later attached wing nut 40.;

3. Placing a wax sealing ring 36 in position to be compressed between soil pipe flange 26 and toilet bowl base 32 under side 52;

4. Lowering the toilet bowl base 32 over the soil pipe flange 26 and the wax sealing ring 36 with the two upright threaded mounting studs 12 passing through openings 56 provided in toilet bowl base 32;

5. Locating a suitable washer 38 over the projecting threaded mounting studs 12;

6. Manually turning a threaded wing nut 40 down the projecting portion of threaded mounting studs 12 until the toilet bowl base 32 is drawn into a fixed and proper position; and 7. Placing decorative cover caps over the wing nut, washer and mounting studs.

As may be apparent to those skilled in the art, the component parts which facilitate the foregoing inventive method offer particular advantages for other reasons. The first of these relates to the fact that the mounting stud retaining clamp 24 will fit all types of soil pipe currently being marketed flanges, regardless of the material from which it is made. Presently, such flanges are available in cast iron, plastic, copper, bronze, etc. These flanges often have different styles of holes or slots of which the mounting slots 28 as shown in FIG. 3 are only one type. However, the mounting stud retaining clamp 24 is particularly designed so that it can be used with various styles of slots or just holes that are used to bolt down toilets. It is noted that the size of the slots on these flanges tend to vary by manufacturer. For instance, the bolt retaining slot is sometimes so wide that the head of a conventional bolt will turn without gripping the sides, thus making it extremely difficult to both tighten the nut and to later on remove the nut. The issue of removing the nut will be dealt with hereinafter.

With copper flanges, none of the bulkheads in current use engage properly. In addition, some flanges do not have an underside recess 54 as shown in FIG. 4. In these cases, there is simply a slot through which the bolt protrudes. Other flanges have only a round hole, which makes the installation of the current bolt very difficult and this is particularly true if there is no underside recess 54. This renders the prior art device of Brewington unusable. In some of these situations, the type of bolt currently used is not effective and a lag screw bolt system must be used. However, the use of a lag bolt necessitates screwing it into the floor to hold down the toilet. This type of installation can create repeated holes in the floor, perhaps causing it to loosen from the supporting surface. Of course, a lag screw method and apparatus will not operate effectively with a concrete or ceramic floor.

The important factor regarding this description is that the mounting stud retaining clamp fits virtually all of these situations, making the installation of a toilet, in accordance with the inventive method, a simple and uncomplicated process even for those not skilled in the art, or even a first time do-it-yourselfer having no skill, judgment or tools.

The foregoing inventive method has been described in connection with a first time toilet installation. However, it is well-known in the art that toilet bowl bases sometimes require removal. For example, removal is necessary when a toilet becomes plugged and cannot be cleared through rodding, or for replacement of a damaged or out-of-date design, or simply for remodeling of a bathroom in which the toilet has been previously been installed. With the current bolt system, moisture in the air or otherwise will cause the bolt and the nut to corrode together over a period of time. Thus, while it is sometimes possible to back off the nut in a conventional installation with a wrench, once the nut is turned one or two turns, the bolt head tends to drop down out of contact or disengage with the soil pipe flange 26, particularly the underside recess 54, if the same is available. Once this happens, the nut often cannot be turned since both the bolt and nut turn together. The problem of removing the nut is compounded in the common situation where the excess bolt length has been sawed off as has been previously described. The result is damage to the threads of the bolt, thus making the passage of the nut sought to be removed extremely difficult. The common practice is then to saw off the bolt so the toilet can be removed, but sawing off the bolt is tedious at best because it is so close to the toilet, and there is substantial risk that the saw will make contact with the toilet bowl base 32 causing permanent disfiguring marks.

Because the invention provides for a fixed mounting stud retaining clamp that will not be disengaged from the soil pipe flange, easy removal of the wing nut 40 is assured, thereby facilitating easy removal of the toilet. Even if the mounting stud and retaining clamp become corroded together in the manner above-described for the conventional bolt and nut, the threaded mounting stud 12 can be removed using a screwdriver in screwdriver slot 48.

Furthermore, the threaded mounting stud 12 should be removable from the mounting retaining clamp 24 even if corroded together, because the threaded mounting stud !2 is firmly fixed to soil pipe flange 26, providing the capability to torque the threaded mounting stud 12 out of mounting stud retaining clamp 24 using a screwdriver. In all but the worst situations, the toilet can be reset on a new wax ring and the components can be readily reused for reassembly using the inventive method.

While the invention has been described in connection with a preferred embodiment, it will be understood that there is no intention to thereby limit the invention. On the contrary, there is intended to be covered all alternatives, modifications and equivalents as may be included within the spirit and scope of the invention as defined by the appended claims, which are the sole definition of the invention.

What is claimed is:

1. A method for installation without using tools of a pre-existing toilet bowl base having at least one pre-existing color matched decorative cover cap and securing the pre-existing toilet bowl base to a soil pipe flange of uncertain height above a floor surface comprising:

placing a retaining clamp that is an eccentric c-shaped resilient structure with a prethreaded orifice in alignment with an aperture in the soil pipe flange:

inserting a lower end of a prethreaded mounting stud, having a headless upper end, into the retainer clamp and through the aperture by manually threading without tools said stud into the prethreaded orifice;

adjusting the prethreaded mounting stud to an appropriate height both to prevent interference with the pre-existing decorative cover cap and to compensate for uncertain height of the soil pipe flange above the floor surface;

placing a waxed sealing ring on the soil pipe flange to be compressed between said flange and the pre-existing toilet bowl base;

orienting the pre-existing base so that at least one opening therein is in alignment with a mounting stud;

lowering said base such that the mounting stud penetrates the opening in said base;

fastening the pre-existing toilet bowl base to the soil pipe flange using a wing nut which is manually threaded without tools down on the mounting stud and hand tightened to avoid axial pressure that would crack the pre-existing toilet bowl base, and in a manner by which later removability and resuability of the mounting stud is assured; and placing the pre-existing decorative cover cap over the wing nut and upper end of the mounting stud to hide the same from view, to protect the same from condensation and other corrosive agents and to hide from view wax that may ooze through the opening in the toilet base from the wax ring compressed between the toilet bowl base and soil pipe flange.

2. The method of claim 1 which further comprises placing a washer over the upper end of the mounting stud after the mounting stud penetrates the opening in the toilet bowl base and before fastening the toilet bowl base to the soil pipe flange by manually threading down a wing nut on the mounting stud.

3. The method of claim 1 wherein later removability of the toilet bowl base and reusability of the mounting stud is assured by additional steps comprising:

placing a screwdriver in a screwdriver slot disposed in the headless upper end of the prethreaded mounting stud; and rotatively threading the mounting stud out of the threaded orifice in the retaining clamp.

* * * * *